US006520309B1

(12) United States Patent
Ishida et al.

(10) Patent No.: US 6,520,309 B1
(45) Date of Patent: Feb. 18, 2003

(54) COIN GUIDE DEVICE

(75) Inventors: Takeshi Ishida, Sakado (JP); Jun Yamada, Kawagoe (JP); Masato Yagi, Urawa (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 0 days.

(21) Appl. No.: 09/674,622

(22) PCT Filed: Mar. 9, 2000

(86) PCT No.: PCT/JP00/01420

§ 371 (c)(1),
(2), (4) Date: Nov. 3, 2000

(87) PCT Pub. No.: WO00/54228

PCT Pub. Date: Sep. 14, 2000

(30) Foreign Application Priority Data

Mar. 11, 1999 (JP) ..... 11-64895

(51) Int. Cl.[7] ..... G07F 1/04
(52) U.S. Cl. ..... 194/344; 193/DIG. 1

(58) Field of Search ..... 194/344, 346, 194/347; 193/44, DIG. 1

(56) References Cited

U.S. PATENT DOCUMENTS 2,433,689 A * 12/1947 Fry ..... 194/239
3,837,454 A * 9/1974 Joeck ..... 194/318

FOREIGN PATENT DOCUMENTS

| | | |
|---|---|---|
| JP | 57-198669 | 12/1982 |
| JP | 3-225587 | 10/1991 |
| JP | 10-124731 | 5/1998 |

* cited by examiner

*Primary Examiner*—Donald P. Walsh
*Assistant Examiner*—Mark J. Beauchaine
(74) *Attorney, Agent, or Firm*—Greer, Burns & Crain, Ltd.

(57) ABSTRACT

A coin biasing unit (21) is arranged in one (4*a*) of the wall surface which constitute a coin guide path (4). The coin biasing unit (21) biases a coin (B) rolling along the coin guide path (4) toward another (4*b*) of the wall surfaces, and is rotatable along the direction in which the coin (B) rolls when it is biasing.

4 Claims, 8 Drawing Sheets

COIN GUIDE DEVICE

TECHNICAL FIELD

The present invention relates to an improvement of a coin guide device that allows an inserted coin to roll in a constant orientation along a coin passage.

BACKGROUND ART

Conventionally, coin sorting devices discriminate inserted coins as genuine and counterfeit, and classify genuine coins according to their denomination, and sort out the genuine coins by distributing them into predetermined coin paths.

In such a coin sorting device, coins that have been inserted through a coin insertion port are guided into one direction by way of a coin guide device comprising a coin guide path, and when they pass a coin discrimination means arranged along the coin guide path, they are classified into genuine and counterfeit, and according to their denomination.

FIG. 6 is a front view of a gate plate 2 showing such a conventional coin guide device 1.

The gate plate 2 a plate that constitutes one side wall 4*a* of a coin guide path 4 for guiding a coin B that has been inserted into a coin insertion port 3 towards the left in the drawing. The gate plate 2 is arranged to cover the upper portion of a main plate (not shown in the drawings), which is part of the main body of the coin sorting device, in such a manner as to be opened and closed.

The gate plate 2 is hinged on a shaft 5 and it can be opened and closed with respect to the main plate (not shown in the drawings) arranged in opposition to its main face, so that when coins are stuck in the coin guide path 4, the coin guide path can be opened, and the coins stuck in there can be removed.

Along the coin guide path 4, a coin discrimination means 6 is set up to classify the inserted coins into genuine and counterfeit and according to denomination.

This coin discrimination means 6 includes an oscillation coil and a receiving coil arranged in opposition to one another at a certain interval. One of the oscillation coil and the receiving coil is arranged on the rear surface of the gate plate 2, and the other one is arranged on the rear surface of the main plate (not shown in the drawings) at a position opposing the gate plate 2.

Based on the changing detection output of the receiving coil when a coin passes between the oscillation and the receiving coil, the coin discrimination means 6 classifies the passing coins into genuine and counterfeit, and according to their denomination.

To increase the precision of the classification of the coins passing the coin discrimination means 6 into genuine and counterfeit and according to their denomination, it is preferable that the inserted coins pass in a constant orientation between the oscillation coil and the receiving coil, which are arranged at a certain interval.

In this conventional coin guide device 1, the other wall surface 4*b* of the coin guide path 4, which is formed by the surface of the main plate 10, is inclined at a certain angle in anti-clockwise direction. With this configuration, an inserted coin B is pushed by the gate rail 11 towards the other inclined wall surface 4*b* as shown in FIG. 7, which shows the cross-section along VII—VII in FIG. 6, and rolls along the coin guide path 4 while keeping this inclined orientation, so that the distance of the oscillation coil and the receiving coil to the coin passing therebetween is kept constant.

Thus, when the inserted coin B passes between the oscillation coil and the receiving coil in a certain inclined orientation, the coin discrimination means can classify the coin reliably into genuine or counterfeit, and according to denomination.

In FIG. 6, numeral 12 denotes a coin pullout prevention lever, numeral 13 denotes a guide rail forming a bottom surface of the coin passage 4, and numeral 14 denotes concave positioning members which are formed along a forming direction of the coin passage 4 and decrease the area of contact with the coin so the coin is guided smoothly. Numeral 30 in FIG. 6 denotes liquid discharge holes for discharging liquids (such as water) that have been introduced through the coin insertion ports 3.

With this conventional coin guide device 1, it can happen that, due to factors such as the orientation in which the coin B falls downward after being inserted through the coin insertion port 3, the coin B is in an upright orientation on the gate rail 11. In other words, it is inclined with respect to the gate plate 2 as shown in FIG. 8, when it rolls along the coin passage 4.

Thus, when the inserted coin B rolls along the coin passage 4 and passes between the oscillation coil and the receiving coil of the coin discrimination means in an upright orientation, the distance between the coin B and the oscillation coil and the receiving coil differs from that of a coin B with an orientation as shown in FIG. 7, so that there is the danger that the coin discrimination device cannot classify the coins reliably into genuine and counterfeit, and according to denomination.

In view of these problems, it is an object of the present invention to present a coin guide device that allows a coin to roll with a constant orientation along a coin passage.

DISCLOSURE OF INVENTION

To solve the aforementioned problems, in accordance with the present invention, a coin guide device having a coin guide path for guiding inserted coins, is characterized in that there is provided a coin energizing means arranged in one of wall surfaces which form a portion of the coin guide path, wherein the coin energizing means is swiveled so as to bias a coin rolling along the coin guide path toward another of the wall surfaces, and is rotatable along a direction in which the coin rolls when it biases the coin.

BEST MODE FOR CARRYING OUT THE INVENTION

The following is a detailed description of a preferred embodiment of a coin guide device in accordance with the present invention.

Figure 1:
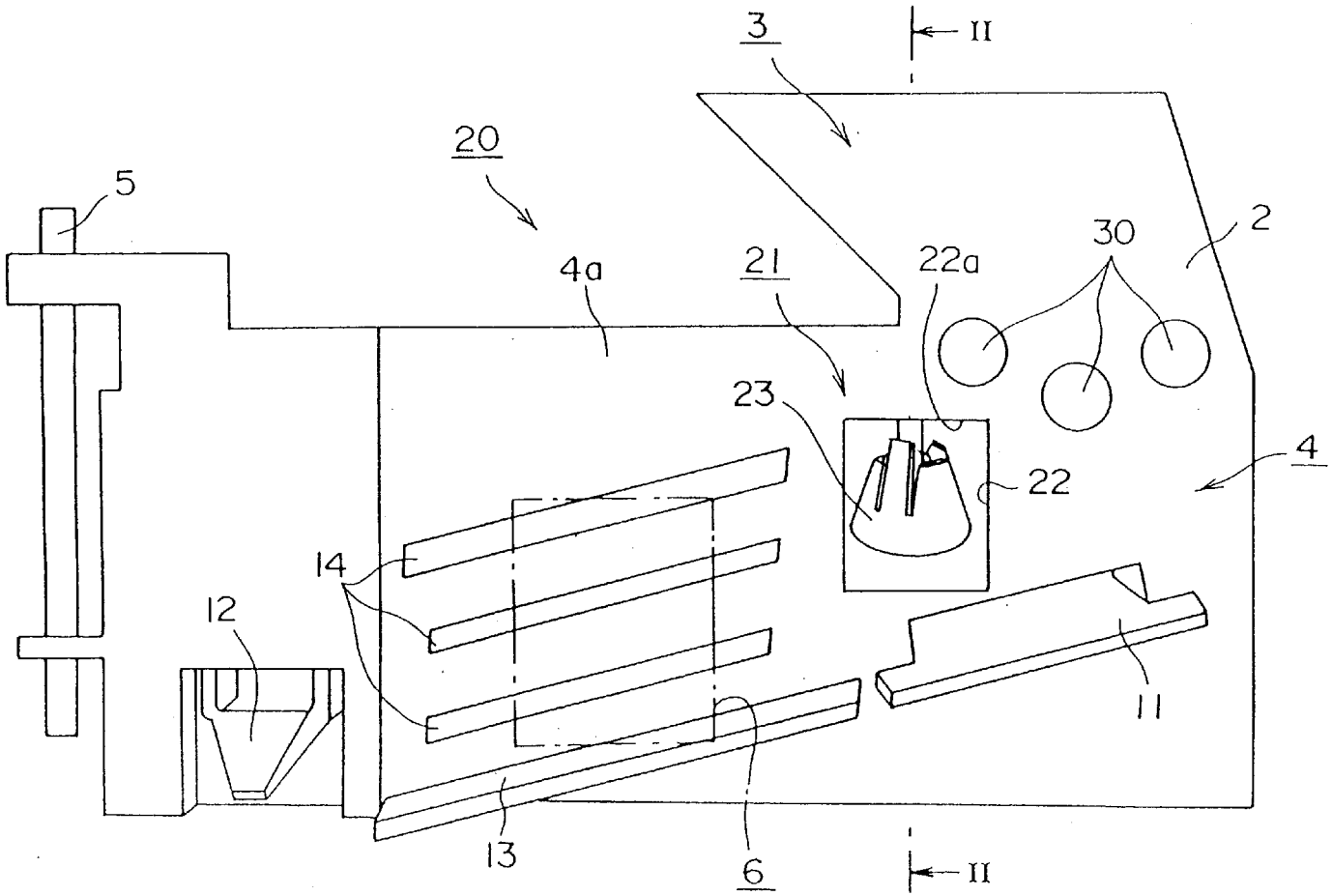
FIG. 1 is a front view of a gate plate showing a coin guide device in accordance with the present invention.
Figure 6:
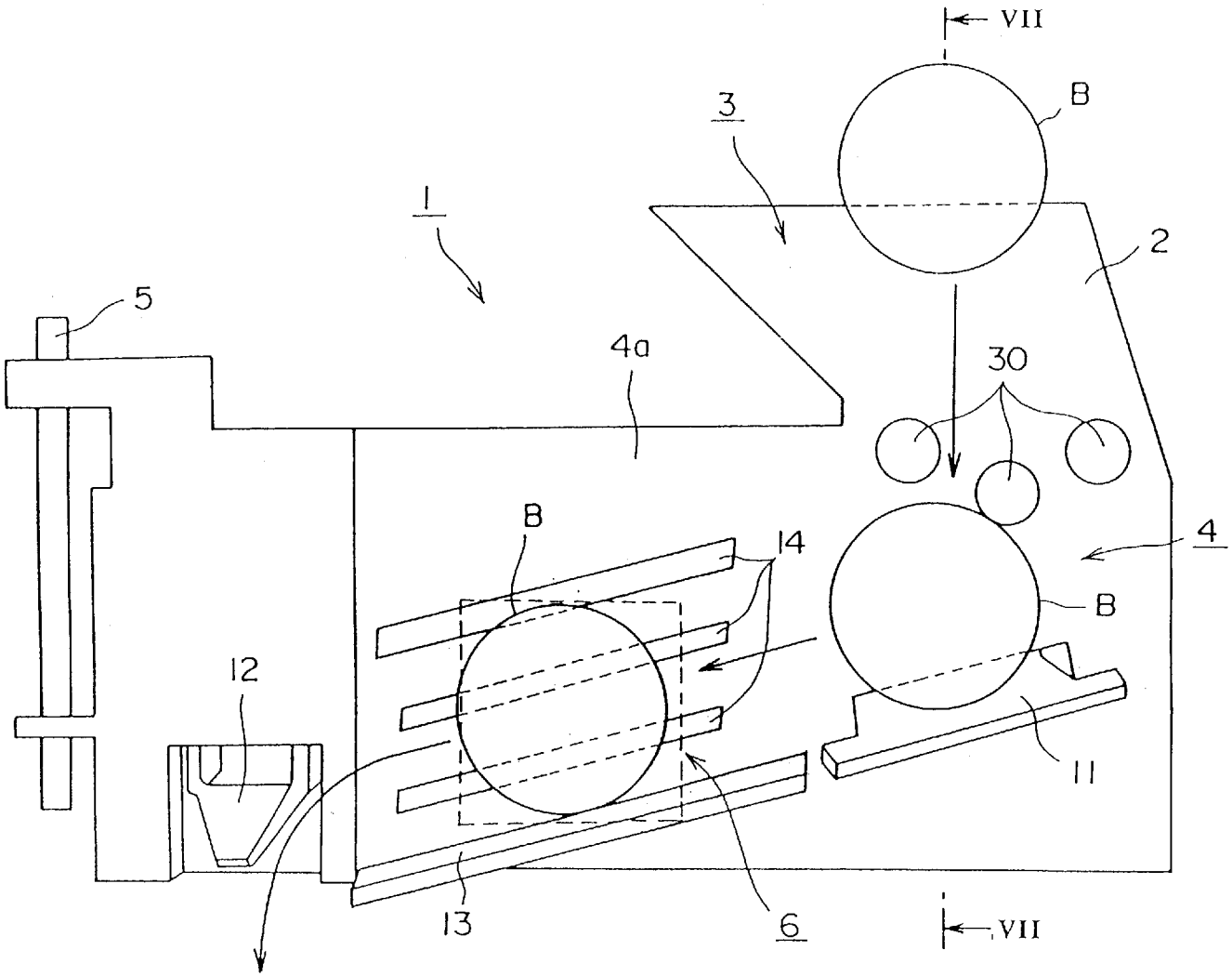
FIG. 6 is a front view of the gate plate showing a conventional coin guide device.
Figure 7:
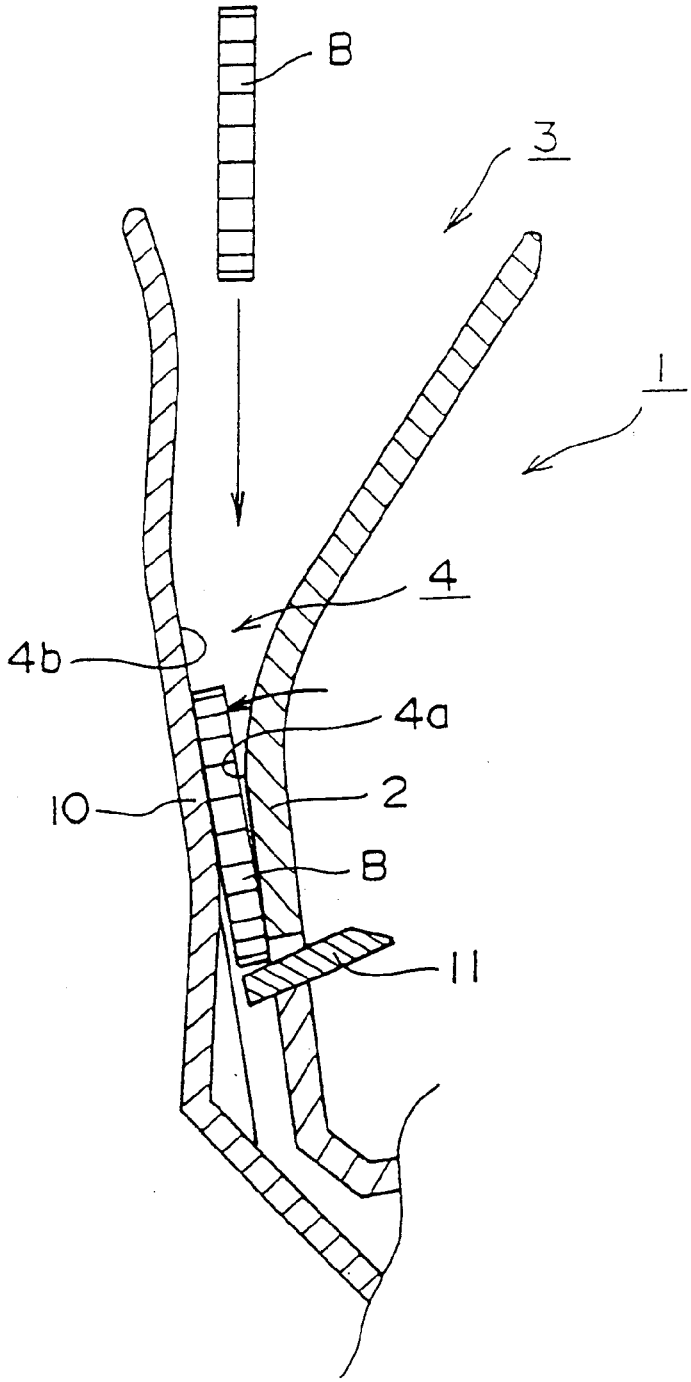
FIG. 7 is a cross-sectional diagram taken along VII—VII in FIG. 6.
Figure 8:
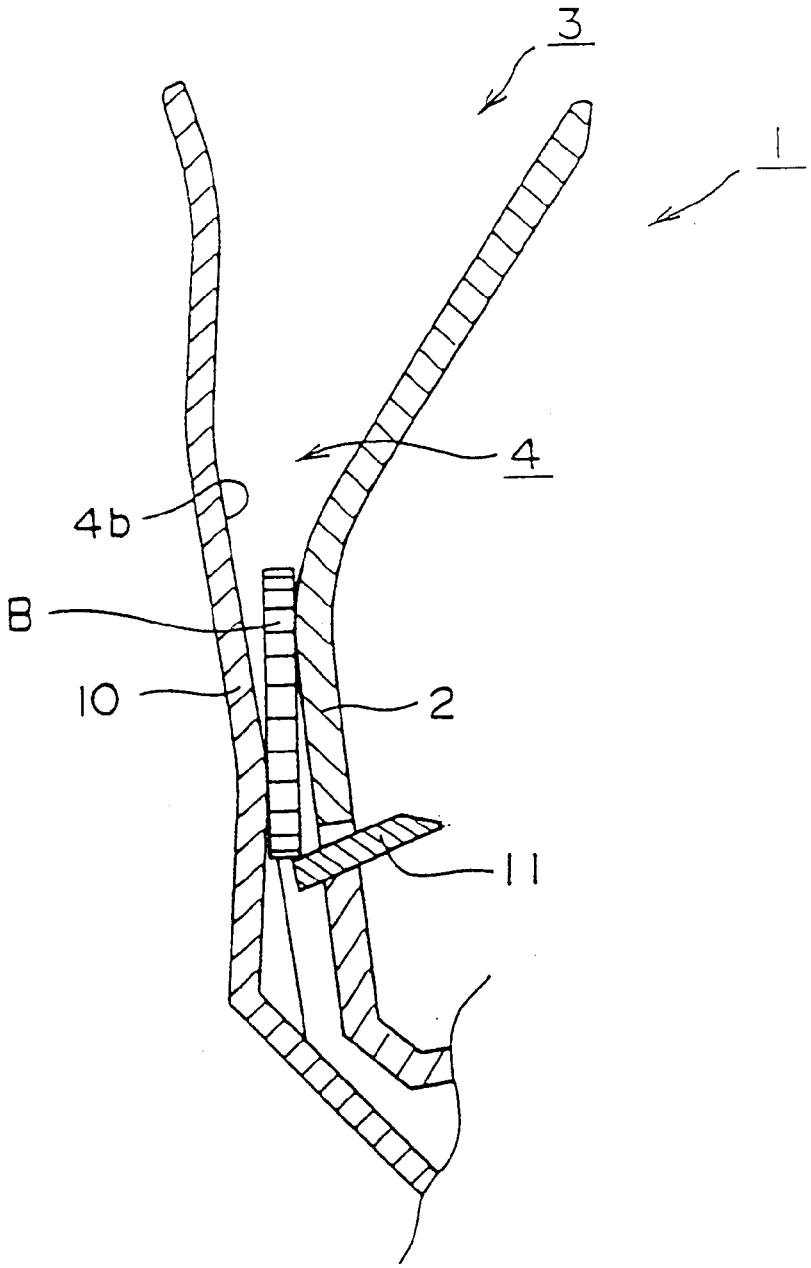
FIG. 8 is a cross-sectional diagram of the conventional coin guide device.

FIG. 1 is a front view of a gate plate 2 provided with a coin guide device 20 in accordance with the present invention. Elements identical to the ones in FIG. 6 are denoted by the same numerals.

In this coin guide device 20, a coin energizing means 21 for biasing coins that roll along a coin guide path 4 that is positioned below a coin insertion port 3 is arranged upstream at that coin guide path 4. The coin energizing means 21 biases the coins towards another wall surface 4*b* (see FIG. 2) formed by the main plate (not shown in the drawings).

The coin energizing means 21 includes a rectangular hole 22 formed in one wall surface 4*a* of the coin guide path 4, and a conical spindle 23 suspended from an upper edge 22*a* of this hole 22.

Figure 2:
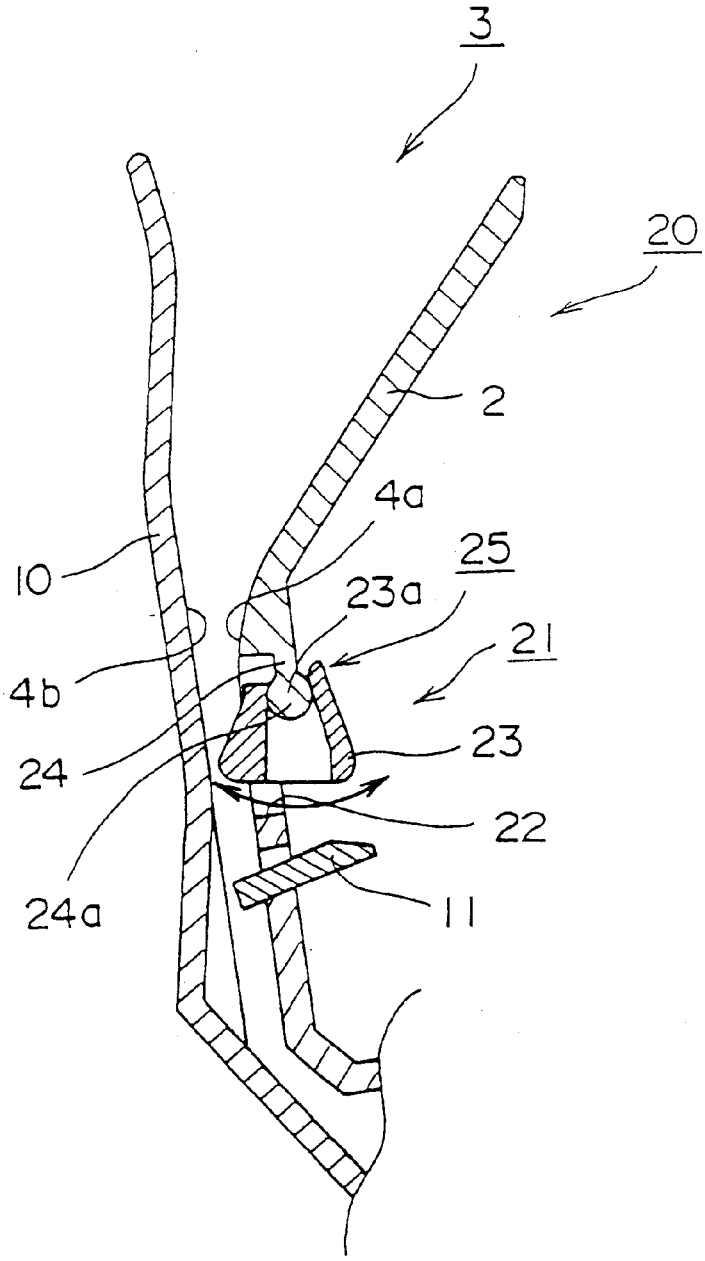
FIG. 2 is a cross-sectional diagram taken along II—II in FIG. 1.

As is shown in FIG. 2, which shows a cross section along II—II in FIG. 1, the spindle 23 is suspended by a swivel joint (spherical joint) 25 at the lower edge of a shaft 24 that is formed in one piece with the gate plate 2. The swivel joint 25 is made of a sphere 24*a* formed in one piece with the lower edge of the shaft 24 and a concave positioning member 23*a* enclosing and slidably engaging the sphere 24*a*.

The concave positioning member 23*a* is formed at the tip of the spindle 23, and is fastened to the sphere 24*a* by which it is supported.

With this swivel joint 25, the spindle 23 can swivel freely in every possible direction around the sphere 24*a*.

That is to say, the spindle 23 can swivel freely to the left and to the right as well as back and forth with respect to the sphere 24*a*, or rotate around the sphere 24*a*, as shown in FIG. 2.

In its initial suspended position, the weight of the spindle 23 forces its lower edge to protrude from the hole 22 towards the wall surface 4*b* on the other side, as shown in FIG. 2.

Figure 3:
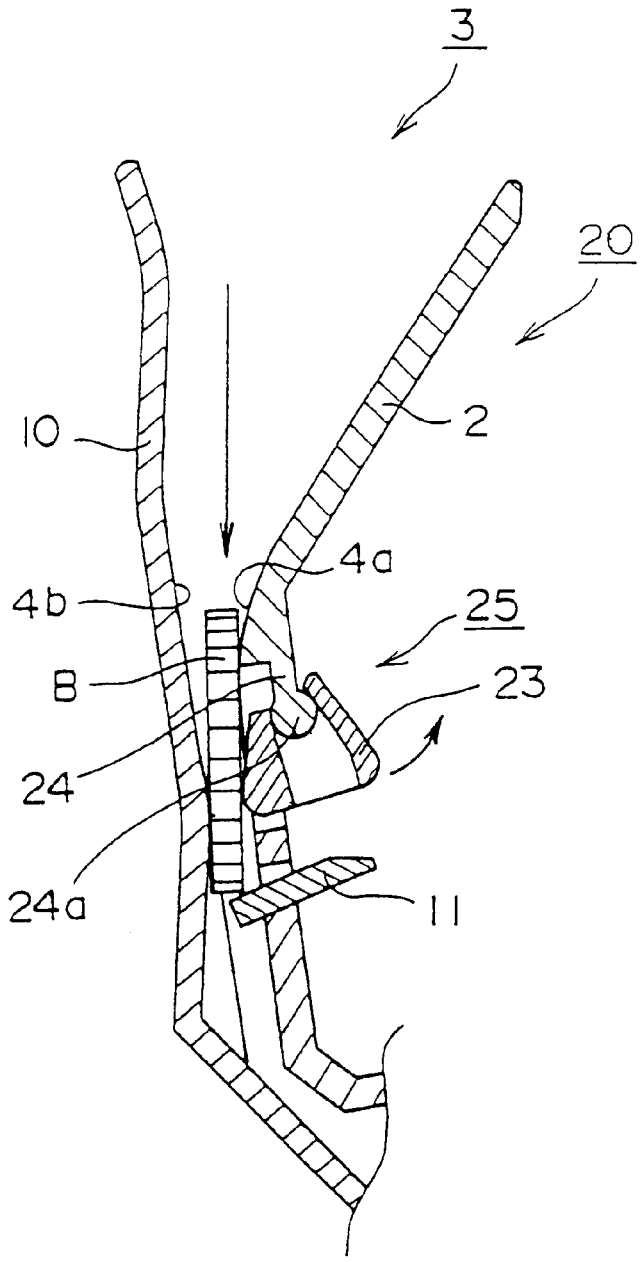
FIG. 3 is a cross-sectional diagram showing the operation of the coin energizing means.
Figure 4:
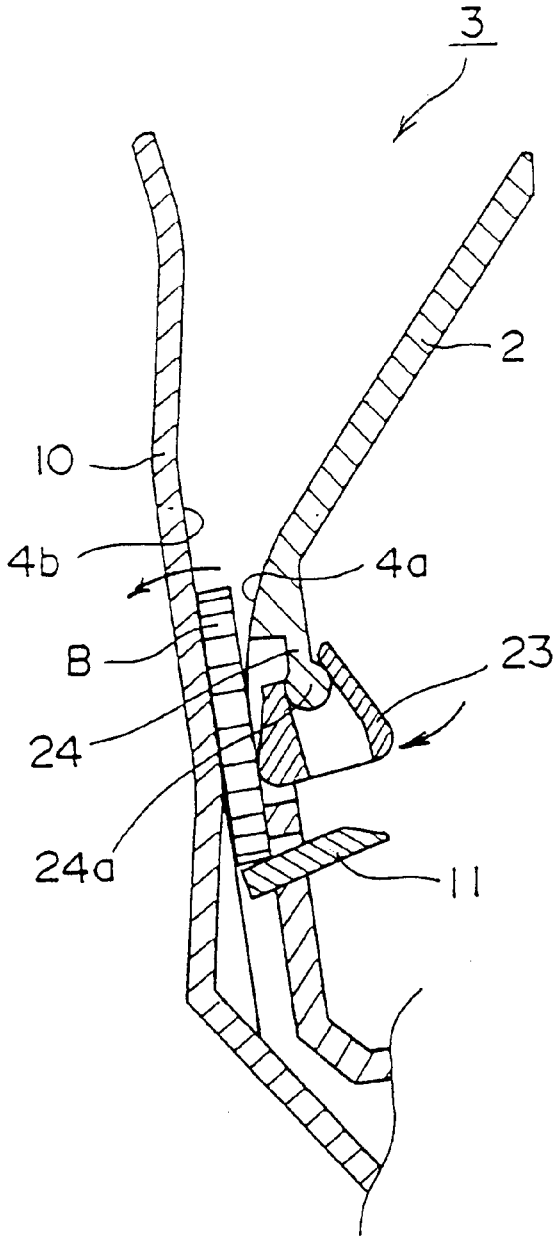
FIG. 4 is a cross-sectional diagram showing the operation of the coin energizing means.

With such a coin energizing means 21, when a coin B that has been inserted through the coin insertion port 3 stands upright on the gate rail 11 due to factors such as the orientation in which it has fallen downward, that is, obliquely with respect to the one wall surface 4*a* of the coin guide path 4, and is about to roll along the coin passage 4 as shown in FIG. 3, then the lower edge of the spindle 23 is forced by its weight to swivel against this oblique coin B, and pushes the coin B towards the other wall surface 4*b* of the coin passage 4, as shown in FIG. 4.

After this, the coin B rolls down toward downstream of the coin guide path 4 with a constant oblique orientation against the other wall surface 4*b*.

Consequently, the inserted coin B is kept in a constant oblique orientation against the other wall surface 4*b* and guided to a coin discrimination means (not shown in the drawings) arranged further downstream along the coin guide path 4, thereby passing always with a constant distance to the oscillation and the receiving coils of the coin discrimination means, so that the coin discrimination means classifies the coins reliably into genuine or counterfeit, and according to denomination.

Figure 5:
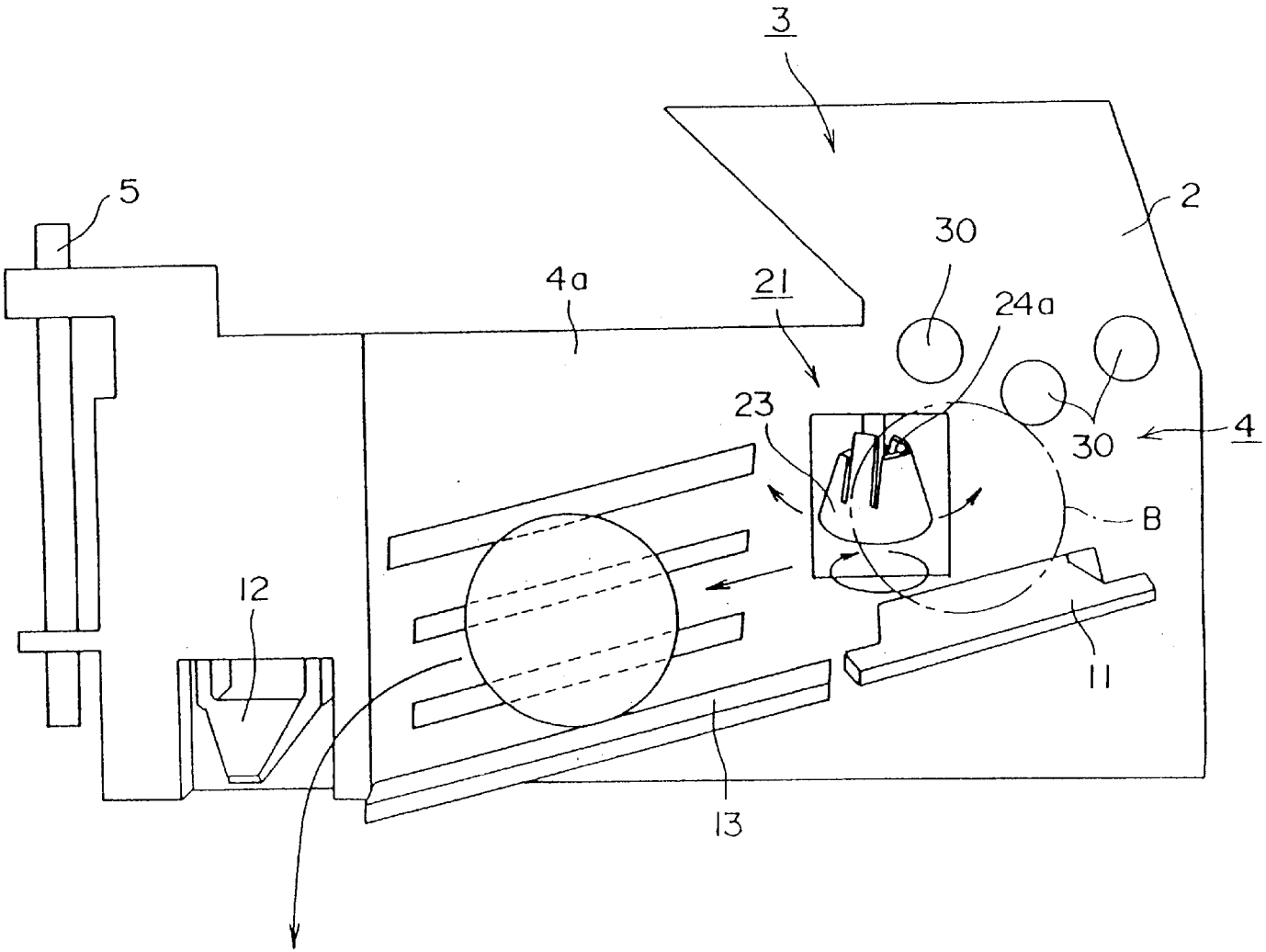
FIG. 5 is a front view of the gate plate showing the operation of the coin energizing means.

As the coin B rolls along the coin guide path 4 while in contact with the spindle 23, the spindle 23 rotates around the sphere 24*a*, as shown in FIG. 5, so that the spindle 23 does not exert a big load on the rolling of the coin B, and the coin B can roll smoothly down the coin guide path 4, allowing for swift coin sorting operations.

In this embodiment, the spindle 23 of the coin energizing means 21 is conical. However, the present invention is not limited to this embodiment or this shape, and the shape of the spindle 23 can also be cylindrical, for example.

The joint 25 for joining the spindle 23 and the lower edge of the shaft 24 (see FIG. 2) is made of a sphere 24*a* and a concave positioning member 23*a* enclosing the same. However, the present invention is not limited to this embodiment, and the spindle 23 can be suspended by a joint of any shape, as long as the spindle 23 can be swiveled in any direction around the shaft 24, and the spindle 23 is rotatable around the shaft.

As has been explained above, a coin guide device of the present invention includes a coin energizing means arranged in one wall surface of the coin guide path, wherein the coin energizing.means can be swiveled so as to bias toward another wall surface a coin rolling along the coin guide path, and is rotatable along the direction in which the coin rolls when it is being biased, so that a coin that rolls along the coin guide path is always kept in a constant orientation when rolling along the coin guide path, whereby a reliable sorting operations becomes possible.

INDUSTRIAL APPLICABILITY

The present invention is applicable to a coin guide device, ill which coins are passed with a constant orientation along a coin passage.

What is claimed is:

1. A coin guide device having a coin guide path for guiding inserted coins, characterized in that there is provided a coin energizing means arranged in one of wall surfaces which form a portion of the coin guide path, wherein the coin energizing means is swiveled so as to bias a side face of a coin rolling along the coin guide path toward another of the wall surfaces, and is rotatable along a direction in which the coin moves when it biases the coin.

2. The coin guide device according to claim 1, wherein the coin energizing means comprises a spindle supported by means of a swivel joint such that it can be swiveled and rotated.

3. The coin guide device according to claim 2, wherein the spindle has a conical shape.

4. The coin guide device according to claim 2, wherein the swivel joint comprises a sphere and a concave positioning member enclosing the sphere.

* * * * *